United States Patent [19]

Cuschera

[11] 4,447,918

[45] May 15, 1984

[54] TAMPER-PROOF POP-UP DRAIN FITTING

[76] Inventor: Casper Cuschera, 1047-77th Ave., Oakland, Calif. 94621

[21] Appl. No.: 423,535

[22] Filed: Sep. 27, 1982

[51] Int. Cl.[3] ..... A47K 1/14

[52] U.S. Cl. ..... 4/286; 220/86 AT; 220/284

[58] Field of Search ..... 4/286–295; 220/86 AT, 284, 285; 137/385; 138/89

[56] References Cited

U.S. PATENT DOCUMENTS

| | | | |
|---|---|---|---|
| 3,849,809 | 11/1974 | Morris et al. | 4/295 |
| 4,103,372 | 8/1978 | Cuschera | 4/287 |
| 4,144,599 | 3/1979 | Cuschera | 4/287 |

*Primary Examiner*—Stephen Marcus

*Assistant Examiner*—Kenneth S. Putnam

*Attorney, Agent, or Firm*—Harris Zimmerman; Howard Cohen

[57] ABSTRACT

In a pop-up drain fitting threadedly secured to a spider at the lower end of the drain body, the improvement comprising a detent member pivotally joined to the lower end of the pop-up drain fitting. A stop member is disposed adjacent to the detent member to permit the detent member rotation in only one direction. The detent member depends downwardly by gravitational force to extend through the spider. Clockwise threading motion of the pop-up fitting into the drain body is permitted by the detent arm; counterclockwise rotation of the pop-up fitting causes the spider to impinge upon the detent arm and drive it into the stop member, thereby preventing removal of the pop-up fitting.

8 Claims, 5 Drawing Figures

TAMPER-PROOF POP-UP DRAIN FITTING

BACKGROUND OF THE INVENTION

In the field of plumbing fixtures and the like, it is well known to provide pop-up drain fittings which selectively seal drain fittings for tubs, sinks, and the like. Generally speaking, such pop-up drain fittings are disposed within a cylindrical drain body, and are secured to the drain body by means of a spider extending diametrically across the lower opening of the drain body. More specifically, the pop-up drain fitting generally includes a central post having a lower threaded end which is received in a medially disposed threaded hole in the spider of the drain body.

It is common practice to employ the pop-up drain fitting by depressing the upper cover of the mechanism to cause a rubber seal to close the upper opening of the drain body. To release this valve, it is necessary only to depress a button on the upper portion of the fitting, or to depress a particular side edge portion of the cover to effect release of the mechanism and opening of the drain.

However, recent experience has shown that it is also common practice for vandals and others to completely remove the pop-up mechanism from drain by unthreading the mechanism from the spider. There is no pop-up drain mechanism known in the prior art which is designed to resist or withstand such tampering or vandalism.

SUMMARY OF THE PRESENT INVENTION

In a pop-up drain fitting threadedly secured to a spider at the lower end of the drain body, the improvement comprising a detent member pivotally joined to the lower end of the pop-up drain fitting. A stop member is disposed adjacent to the detent member to permit the detent member rotation in only one direction. The detent member depends downwardly by gravitational force to extend through the spider. Clockwise threading motion of the pop-up fitting into the drain body is permitted by the detent arm; counterclockwise rotation of the pop-up fitting causes the spider to impinge upon the detent arm and drive it into the stop member, thereby preventing removal of the pop-up fitting.

DESCRIPTION OF THE PREFERRED EMBODIMENT

Figure 1:
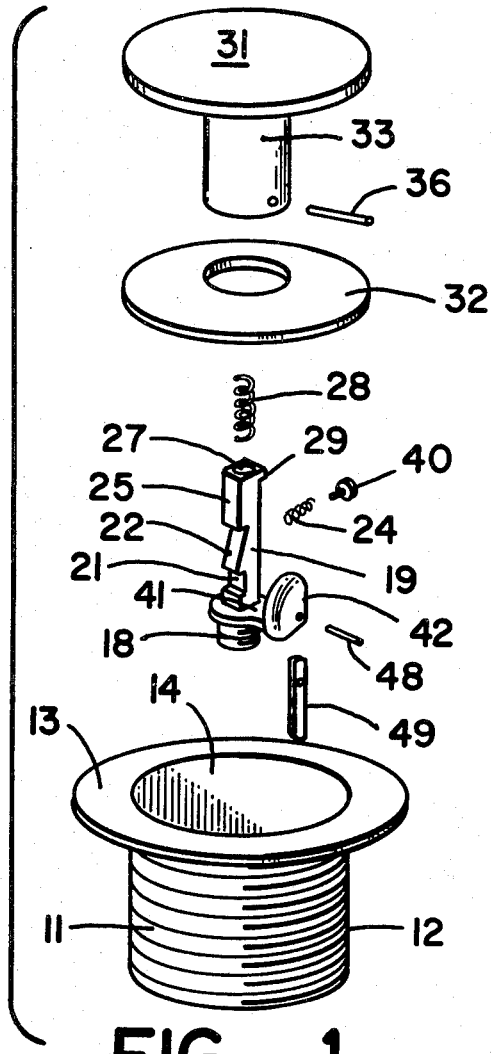
FIG. 1 is an exploded view of one embodiment of the tamper-proof pop-up drain mechanism of the present invention.
Figure 3:
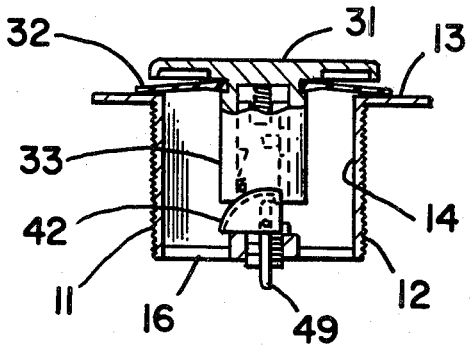
FIG. 3 is a partial cross-sectional elevation of the embodiment of the present invention as depicted in FIGS. 1 and 2.

The present invention generally comprises an improved pop-up drain mechanism which is designed to resist tampering with or removal of the pop-up mechanism from the drain body. A pop-up drain assembly, including the pop-up mechanism and the drain body, generally includes a tubular body member 11 which is provided with external threads 12. The body member 11 includes an axially disposed bore 14 and a radially outwardly extending flange 13 extending from the upper end of the body member. At the lower end of the body member 11 there is secured a spider 16 which supports an axially disposed ring 17. The ring 17 is provided with a concentrically disposed threaded hole 20, as shown for example in FIG. 4.

The pop-up drain mechanism includes a generally rectangular post 19 which is provided with a lower threaded end 18 adapted to be secured in the threaded hole 20 of the ring 17. One vertical surface 25 of the rectangular post 19 is provided with a laterally extending detent slot 21. The same vertical surface is also provided with a ramped camming surface 22 extending from the upper lip of the slot 21 upwardly and obliquely inwardly as shown in FIG. 1.

The vertical surface 30 of the rectangular post, which is opposed to the vertical surface 25, is provided with a radially extending hole 23. Disposed in the hole 23 is a helical compression spring 24, and a flat head biasing member 40 having a short shank extending inwardly therefrom is received in the hole 23 and within the coils of the spring 24. The spring 24 biases the member 40 radially outwardly, for reasons which will be explained in the following description. Extending from the upper end of the surface 30 is a lip 29. As shown in FIGS. 1 and 3-5, the lip 29 extends laterally outwardly only from the surface 30.

Disposed in the top of the rectangular post 19 is a center bore 27. Seated in the bore 27 is a helical compression spring 28, which extends upwardly from the rectangular post. The function of the spring 28 will also be made apparent in the following description.

The pop-up drain mechanism also includes a generally disk-like drain cover 31. Extending downwardly from the drain cover and disposed concentrically with the axis thereof is tubular member 33. The tubular member 33 is provided with a reduced diameter annulus 35. An annular sealing gasket 32 is resiliently secured in the annulus 35, with the peripheral portion thereof angled slightly downwardly with respect to the cover 31. The outer diameter of the gasket 32 is greater than the diameter of the bore 14 of the drain body member, and the peripheral edge of the gasket is adapted to impinge on the flange 13 in sealing fashion to prevent any flow through the bore of the drain.

As shown in the Figures, the chamber 34 within the tubular member 33 receives the rectangular post 19. The width of the post from side 25 to side 30 is less than the diameter of the chamber 34, and the tubular portion 33 is disposed parallel to the post 19 and laterally offset therefrom. The lip 29 extending from the side 30 of the post maintains the lateral offset of the tubular portion 33, and the spring biased member 40 maintains the tubular portion in generally parallel alignment with the post 19. It may be appreciated, however, that the cover member 31 may be rocked or pivotted about the lip 29, the member 40 being urged against the spring force of spring 24 into the hole 23.

Figure 5:
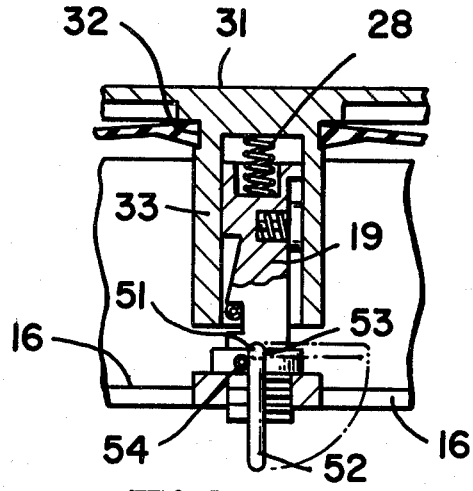
FIG. 5 is a cross-sectional elevation of a further embodiment of the tamper-proof pop-up drain mechanism.
Figure 2:
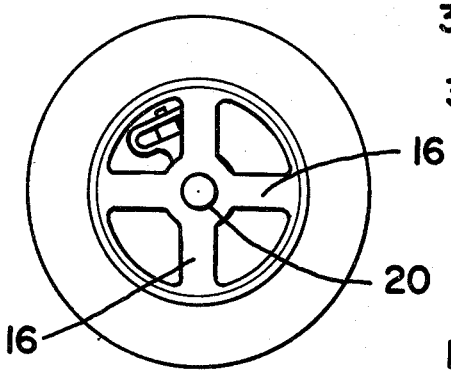
FIG. 2 is a bottom view of the embodiment of the present invention as depicted in FIG. 1.
Figure 4:
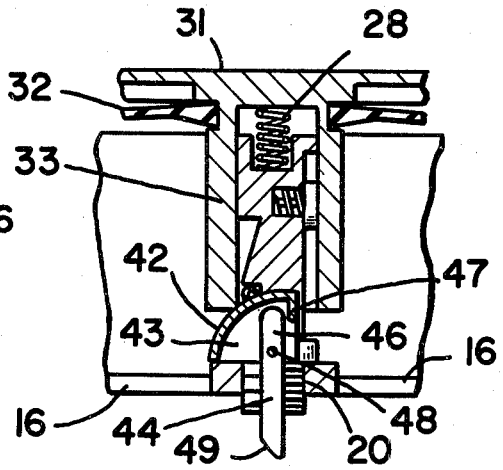
FIG. 4 is a cross-sectional elevation of the embodiment depicted in FIGS. 1-3.

A latch pin 36 is also provided in the lower end of the tubular member 33, extending along a chord through the chamber 34. The latch pin 36 is disposed adjacent to the camming surface 22, and is adapted to be retained in the detent slot 21, as shown in FIGS. 4 and 5.

The pop-up drain mechanism described herein is known in the prior art, and is described in greater detail in U.S. Pat. No. 4,144,599, issued Mar. 20, 1978, and U.S. Pat. No. 4,103,372, issued Feb. 28, 1977, both patents being issued to Casper Cuschera. These patents are incorporated herein by reference.

It may be understood that the compression of the spring 28 biases the cover 31 upwardly, so that the gasket 32 clears the flange 13 of the drain body by a substantial margin. In this configuration, there is free flow through the gap defined by the gasket 32 and the flange 13. The pop-up mechanism may be closed by manually urging the cover 31 downwardly. As the cover is depressed, the latch pin 36 rides the camming surface 22 and is received in the detent slot 21 to maintain the cover in the closed position. In this position, the peripheral rim of the gasket 32 impinges upon the flange 13 to prevent any water outflow through the bore 14. The pop-up mechanism is opened by depressing an edge portion of the cover to release the latch pin 36 from the slot 21. In other forms of pop-up mechanisms, a push-button extending upwardly from the cover may be provided to effect release of the mechanism and opening of the valve.

The present invention is an improvement over prior art pop-up mechanisms, the improvement being specifically directed toward preventing vandalism of and tampering with such pop-up mechanisms. With reference to FIGS. 1–4, the present invention includes a lug 41 extending radially outwardly from the lower end portion of the post 19. The lug 41 is disposed directly superjacently of the threaded lower end 18 of the post. Joined to the distal end of the lug 41 is a housing 42. The housing 42 is provided with a generally arcuate cross-sectional elevational configuration, as shown in FIG. 4, and includes a slot opening 43 therein which generally defines a segment of a circle. A detent arm 44 includes an upper portion 46 which is received within the slot opening 43 of the housing 42, with a pivot pin 48 extending through the housing and the arm 44. The housing 42 also includes a stop member 47 which limits rotational movement of the upper end 46 of the arm 44 to a substantially vertical disposition, as shown in FIG. 4. However, the arm 44 is generally free to pivot in the counter-clockwise direction. It may be noted that the lower distal end of the arm 44 is provided with a blended curved terminus 49.

When the pop-up mechanism is initially installed in the drain body 11, the lower end 18 is threaded into the threaded hole 20 of the drain spider. The arm 44 depends downwardly by gravital force and the pop-up mechanism is rotated clockwise, as viewed from above, to engage the threaded end 18. During this procedure, the arm 44 is caused to repeatedly traverse the arms 16 of the drain body spider. However, due to the fact that the arm 44 may rotate freely in the direction necessary to clear the arms 16 of the spider, installation of the pop-up mechanism in the drain body is not impaired in any way.

However, once the pop-up mechanism is installed, removal of the pop-up mechanism requires rotation of the post 19 and its associated mechanism in the counterclockwise direction to unthread the end 18. This motion causes the spider arms 16 to impinge upon the detent arm 44 and drive the upper end 46 thereof to impinge upon the stop member 47. Thus the arm 44 cannot rotate to clear the spider arms 16, and the pop-up mechanism is prevented from rotating to effect removal thereof. Thus tampering and vandalism of the pop-up mechanism is also prevented. It may be appreciated that the drain cover prevents manual intervention with the arm 44, due to the restricted clearance thereby.

In a further embodiment of the present invention, depicted in FIG. 5, the pop-up mechanism and its assembly to the drain body is substantially as described in the preceding embodiment. However, rather than the boss and housing arrangement of the preceding embodiment, the present embodiment includes a hole 51 extending radially through the post 19 and disposed directly superjacently of the threaded end 18. A latch arm 52 includes a lower portion which depends gravitally through the plane of the spider arms 16, and an upper dog leg portion 53 extending at right angles to the portion 52 and received in rotatable fashion within the hole 51. Disposed directly adjacent to the hole 51 and slightly therebelow is a stop pin 54 extending radially outwardly from a hole provided in the post 19. It may be appreciated that the lower portion of the arm 52 is adapted to rotate from its generally downwardly extending disposition, through a counterclockwise angular excursion, to the disposition shown in phantom line in FIG. 5. However, the stop pin 54 prevents rotation of the lower end 52 from the downwardly extending disposition through any clockwise angular excursion.

As in the previous embodiment, the arm 52 may pivot freely upon impingement with the spider arms 16 when the pop-up mechanism is being threaded in clockwise fashion into the hole 20 of the spider portion. However, the stop pin 54 prevents the member 52 from pivotting in the direction necessary to clear the spider arm 16 when the pop-up mechanism is being rotated in a counterclockwise direction to remove the pop-up mechanism. Thus the embodiment depicted in FIG. 5 functions in substantially the same way to prevent tampering and vandalism of the pop-up drain fitting.

I claim:

1. In a pop-up drain fitting including a post threadedly secured to a spider at the lower end of the drain body, the improvement comprising; a detent member pivotally joined to the lower end of the pop-up drain fitting post, said detent member extending gravitally through the nominal plane of the spider, stop member means disposed adjacent to the detent member to prevent rotation of said detent member in only one direction, said detent member being driven to rotate in said one direction by impingement on said spider when said pop-up mechanism is unthreaded from said spider.

2. The improved pop-up drain fitting of claim 1, further including a lug extending radially outwardly from said post adjacent to the lower end of said post.

3. The improved pop-up drain fitting of claim 2, further including a housing joined to the distal end of said lug, said housing including a slot opening extending through a lower portion thereof.

4. The improved pop-up drain fitting of claim 3, further including a pivot pin extending through said housing and said detent member, said detent member being rotatably supported by said pivot pin.

5. The improved pop-up drain fitting of claim 4, wherein the upper portion of said detent member is freely received within said housing.

6. The improved pop-up drain fitting of claim 5, wherein said stop member means comprises a stop member disposed in said slot opening and positioned to impinge upon said upper portion of said detent member in a predetermined angular orientation and to prevent rotation of said detent member in said one direction past said predetermined angular orientation.

7. The improved pop-up drain fitting of claim 1, further including a hole extending radially in said post, said detent member including a first portion extending generally downwardly, and a second portion extending orthogonally to said first portion and received in said hole in rotating fashion.

8. The improved pop-up drain fitting of claim 7, wherein said stop member includes a stop pin extending outwardly from said post and disposed to impinge upon said first portion of said detent member in a predetermined angular orientation and to prevent rotation of said detent member in said one direction past said predetermined angular orientation.

* * * * *